US006192844B1

(12) United States Patent
Scheidt et al.

(10) Patent No.: US 6,192,844 B1
(45) Date of Patent: Feb. 27, 2001

(54) DEVICE FOR VARYING THE CONTROL TIMES OF GAS-EXCHANGE VALVES OF AN INTERNAL COMBUSTION ENGINE IN PARTICULAR A CAMSHAFT ADJUSTING DEVICE WITH AN IMPELLER

(75) Inventors: Martin Scheidt, Adelsdorf; Andreas Strauss, Forchheim, both of (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/472,469

(22) Filed: Dec. 27, 1999

(30) Foreign Application Priority Data

Dec. 28, 1998 (DE) ..... 198 60 418

(51) Int. Cl.[7] ..... F01L 1/344
(52) U.S. Cl. ..... 123/90.17; 123/90.31
(58) Field of Search ..... 123/90.15, 90.17, 123/90.31; 74/568 R; 464/1, 2, 160

(56) References Cited

U.S. PATENT DOCUMENTS 5,826,552 * 10/1998 Noguchi et al. ..... 123/90.17
6,014,952 * 1/2000 Sato et al. ..... 123/90.17
6,079,382 * 6/2000 Schafer et al. ..... 123/90.17

FOREIGN PATENT DOCUMENTS 19844646 5/1999 (DE) .

* cited by examiner

*Primary Examiner*—Weilun Lo
(74) *Attorney, Agent, or Firm*—Bierman, Muserlian and Lucas

(57) ABSTRACT

A device for varying the control times of gas-exchange valves of an internal combustion engine, which has between the impeller (8) and the drive wheel (2) an additional angle-limiting device (26) with the aid of which the maximum pivoting angle of the impeller, which is limited per se by the lateral surfaces (15, 16) of the bounding walls (13) in the drive wheel (2), can be reduced with respect to the drive wheel (2) to a smaller pivoting angle.

7 Claims, 3 Drawing Sheets

DEVICE FOR VARYING THE CONTROL TIMES OF GAS-EXCHANGE VALVES OF AN INTERNAL COMBUSTION ENGINE IN PARTICULAR A CAMSHAFT ADJUSTING DEVICE WITH AN IMPELLER

DESCRIPTION

1. Field of the Invention

The invention relates to a device for varying the control times of gas-exchange valves of an internal combustion engine according to the features of claim 1 which form the preamble, and it can be implemented with particular advantage in camshaft adjusting devices with an impeller.

2. Background of the Invention

Such a device is previously known in a generically determined fashion from DE-A 196 23 818. This device comprises, on the one hand, a drive wheel which is constructed as an outer rotor and is connected in driving terms to a crankshaft of the internal combustion engine via a drive chain and has a cavity formed by a hollow cylindrical peripheral wall and two side walls and is constructed on one of its side walls with a tooth system for the drive chain. On the other hand, the device comprises an impeller which is constructed as an inner rotor, is connected in a rotationally fixed fashion to the camshaft of the internal combustion engine, is inserted into the cavity of the drive wheel, and has two or more radially arranged blades on the peripheral surface of its wheel hub. Moreover, extending from the inner lateral surface of the peripheral wall of the drive wheel into the cavity of the drive wheel are at least two or more radial bounding walls which are directed toward the longitudinal center axis of the drive wheel and are operationally connected to the wheel hub of the impeller, so that two or more hydraulic operating chambers are formed inside the device by the lateral surfaces of the bounding walls and by the inner lateral surface of the peripheral wall of the drive wheel together with the peripheral surface of the wheel hub of the impeller. In this case, each operating chamber of the device is subdivided in turn into in each case two hydraulic pressure chambers acting against one another by in each case one blade of the impeller extending into this operating chamber, which pressure chambers, given an optional or simultaneous application of pressure by a hydraulic pressure fluid within a maximum pivoting angle, effect a pivoting movement or fixing of the impeller with respect to the drive wheel, and thus of the camshaft with respect to the crankshaft.

In addition, the device in accordance with DE-A 196 23 818 is constructed in such a way that in the absence of the application of pressure by in each case one pressure chamber of the device, the impeller and a drive wheel can be intercoupled by a locking element in a preferred mutual position, which is constructed in the particular case as a so-called axial pin and is arranged together with a compression spring in an axial bore in the impeller. This axial pin can be displaced by the force of the compression spring into a coupling position in a locking bore which is recessed into the opposite inner side of a side wall of the drive wheel and is connected hydraulically to one of the pressure chambers of the device in such a way that upon application of pressure by this pressure chamber the axial pin moves again by the hydraulic pressure fluid into its decoupling position in the axial bore in the impeller.

It is disadvantageous in this known device that the maximum pivoting angle, limited by the lateral surfaces of the bounding walls in the drive wheel, of the impeller is fixed with respect to the drive wheel in accordance in each case with the engine-specific conditions of a specific design of an internal combustion engine by a specific number and size of the bounding walls and of the blades of the device, and can no longer be varied. Since the respective engine-specific conditions on each internal combustion engine thereby set bounds to the maximum pivoting angle of such devices, and also require different maximum pivoting angles of the devices in the case of different designs of internal combustion engines, the use of a device with a uniform pivoting angle for a plurality of designs of internal combustion engines is not possible, and the device needs to be adapted in a complicated way for each individual design of an internal combustion engine. However, in the production of such devices for different designs of internal combustion engines, this impairs the use of identical parts, and therefore necessitates a cost-intensive production of a multiplicity of similar components for the purpose of implementing different maximum pivoting angles. If, in this case, these components are produced, for example, by sintering, the increased production costs of such devices are further influenced negatively by virtue of the fact that separate sintering tools are required for each device having a different maximum pivoting angle.

OBJECT OF THE INVENTION

It is therefore the object of the invention to design a device for varying the control times of gas-exchange valves of an internal combustion engine, in particular camshaft adjusting devices with an impeller which, owing to the possibility of simple adaptation of the maximum pivoting angle of the impeller with respect to the drive wheel using as many identical parts as possible to produce it on different designs of internal combustion engines.

SUMMARY OF THE INVENTION

According to the invention, this object is achieved in such a way that the device has between the impeller and the drive wheel an additional angle-limiting device with the aid of which the maximum pivoting angle of the impeller, which is limited per se by the lateral surfaces of the bounding walls in the drive wheel, can be reduced with respect to the drive wheel to a smaller pivoting angle. In this case, a virtually stepless reduction in the pivoting angle is possible merely by exchanging a component of the device or an element of this angle-limiting device for another component, which likewise reduces the pivoting angle, of the device or an element of the angle-limiting device, and the device can be used while retaining all the remaining components on all designs of internal combustion engines for which the possible relative angle of rotation between their camshaft and their crankshaft is smaller than or equal to the maximum pivoting angle, limited by the lateral surfaces of the bounding walls in the drive wheel, of the impeller with respect to the drive wheel.

In an expedient development of the device according to the invention, the additional angle-limiting device on the one hand comprises an angle-limiting groove in the shape of an annular segment recessed into the inner side of a side wall of the drive wheel and whose radius origin is arranged on the longitudinal center axis of the device and on the other hand comprises a stop bolt which is arranged on the axial end of the impeller, which is situated opposite this side wall, and projects into the angle-limiting groove in the side wall of the drive wheel. In this case, the groove ends of the angle-limiting groove are constructed as angle-limiting stops against which the stop bolt is arranged to bear in the maximum pivoting positions of the impeller with respect to the drive wheel.

The devices are additionally constructed in a way known per se such that in the absence of the application of pressure by in each case one pressure chamber of the device, the impeller and the drive wheel can be intercoupled by a locking element in at least one preferred mutual position, the locking element being constructed as an axial pin which is arranged, together with the compression spring in an axial bore in the impeller and can be displaced by the spring force into a coupling position in a locking bore in the opposite inner side of a side wall of the drive wheel. In this case, the locking bore in the side wall of the drive wheel is connected hydraulically to a pressure chamber of the device in such a way that upon application of pressure by this pressure chamber the axial pin can be moved again by the hydraulic pressure fluid into a decoupling position in the axial bore in the impeller.

In a first preferred embodiment of the device according to the invention, the stop bolt of the angle-limiting device is therefore fastened inside an axial blind bore in the wheel hub of the impeller, which optionally is recessed into one of the two axial ends of the wheel hub and is arranged radially opposite the locking element, which is likewise arranged in the wheel hub of the impeller, of the device. In this case, the stop bolt projects with a part of its length from this blind bore and is preferably constructed as a fitted pin which is fastened in the blind bore by means of an interference fit or by a transition fit, or is loosely guided. As an alternative to this, it is also possible to construct the stop bolt and the blind bore with a thread, and to screw the stop bolt in the blind bore, or else to weld the stop bolt in the blind bore. The associated angle-limiting groove of the angle-limiting device is consequently likewise arranged radially opposite the locking element in the respective one or other side wall of the drive wheel, it having proved to be advantageous to arrange the stop bolt on the same axial end of the wheel hub of the impeller as the locking element, and to arrange the angle-limiting groove in the same side wall as the locking bore of the locking element. Given blades of the impeller which are of appropriately solid construction, and adequate conditions of space, however, it is also possible to recess the axial blind bore of the stop bolt into a blade of the impeller, and to fasten the stop bolt in the described way in the blind bore and/or also to arrange both in another way than radially opposite the locking element. It is likewise essential to the invention in this case on which axial end of the impeller the stop bolt is fastened and/or in which side wall of the drive wheel the angle-limiting groove is recessed.

As a second preferred embodiment of the device according to the invention, it is proposed, by contrast, to fasten the stop bolt of the angle-limiting device not in a separate blind bore but, in an advantageous way, inside the already existing axial bore, which is constructed as a through bore and arranged in the wheel hub of the impeller, for the locking element of the device, and likewise in this case to arrange it with a part of its length projecting from this axial bore. This means that both the locking element of the device and the stop bolt of the angle-limiting device are arranged in one and the same bore in the wheel hub of the impeller, the stop bolt being arranged optionally on one of the two axial ends of the wheel hub in a fashion axially opposite the locking element in each case, and simultaneously being constructed at the rear as a support element for the compression spring thereof. In the case of this embodiment as well, the stop bolt can be constructed here as a fitted pin which is fastened by means of an interference fit or by a transition fit in the axial bore, or is guided loosely, or it can be provided with a thread with the aid of which fit is screwed into the axial bore, which is likewise constructed with a thread. However, it is also possible to weld the stop bolt in the axial bore, or else to construct the stop bolt entirely or partially as a hollow pin open at the rear which is pressed or screwed into the axial bore and whose cavity is used to guide and support the compression spring of the locking element. However, in every case the stop bolt of the angle-limiting groove and the locking element of the device are arranged at the respectively opposing ends of the axial bore in the wheel hub, with the result that the associated angle-limiting groove of the angle-limiting device is always arranged in the side wall of the drive wheel which is axially opposite the side wall with the locking bore for the locking element. Moreover, just as in the case of the first embodiment described, it is also possible with this embodiment of the device according to the invention, given blades of the impeller which are of appropriately solid construction and adequate conditions of space to arrange the axial bore for the locking element and for the stop bolt in a blade of the impeller, it being essential to the invention on which axial end of the blade the stop bolt of the angle-limiting device is arranged, and on which axial end of the blade the locking element of the device is arranged.

Independently of the implementation of the described first or second embodiment, it is a further feature of the device according to the invention that the side wall, provided with the angle-limiting groove, of the drive wheel is constructed as the exchangeable part of the device provided for the virtually stepless reduction of the pivoting angle between the impeller and the drive wheel. The virtually stepless reduction of the pivoting angle takes place in this case merely by changing the length of the angle-limiting groove via its radius, or by shortening the spacing between the groove ends, constructed as angle-limiting stops, of the angle-limiting groove, with the result that while retaining all the remaining components of the device merely one side wall of the drive wheel needs be changed in order to convert the entire device from the engine-specific conditions of one design of an internal combustion engine which are decisive for the respective maximum pivoting angle to the engine-specific conditions of another design of an internal combustion engine.

In an advantageous refinement of the device according to the invention, it is, finally, proposed that the width of the angle-limiting groove in the shape of an annular segment and the doubled radius of its groove ends are constructed slightly greater than the diameter of the stop bolt, and the angle-limiting groove is preferably constructed slightly deeper than the part of the length of the stop bolt projecting from the blind bore or from the axial bore in the wheel hub of the impeller. As a result, during the adjusting operation of the device, the stop bolt of the angle-limiting device can move absolutely free from contact relative to the side wall of the drive wheel inside the angle-limiting groove, and no sort of frictional losses occur owing to the additional angle-limiting device. The groove ends, which are of enlarged radius, of the angle-limiting groove have the effect that, in the maximum pivoting positions of the impeller, the stop bolt, which is of smaller diameter, bears in each case against these groove ends solely in a punctiform or linear fashion and can move away again to these groove ends from the groove ends of the angle-limiting groove without overcoming adhesion forces which may occur.

By contrast with the devices known from the prior art, the device according to the invention for varying the control times of gas-exchange valves of an internal combustion engine, in particular a camshaft adjusting device with an impeller therefore have the advantage of the possibility of a simple and cost-effective adaptation of the maximum pivoting angle in accordance with the engine-specific conditions of different designs of internal combustion engines by means of an additional angle-limiting device for reducing the maximum pivoting angle of the impeller, which is limited per se by the lateral surfaces of the bounding walls in the drive wheel, with respect to the drive wheel. This angle-limiting device requires in this case only a minimum of additional components and measures, and is advantageously configured in such a way that an adaptation of the entire device to a plurality of designs of internal combustion engines is possible merely by varying a side wall of the drive wheel of the device while retaining a multiplicity of identical parts. As a result, all that is still required is to design a single basic type of a device according to the invention for a wide range of different designs of internal combustion engines, with the result that the design outlay, for adapting a device according to the invention to the respective application is minimized. At the same time, the production costs for each device designed according to the invention are substantially lowered, since the use of separate, expensive tools for each device with a different maximum pivoting angle of the impeller with respect to the drive wheel can be eliminated, and all that need now be done is to produce similar side walls with angle-limiting grooves of different lengths.

BRIEF DESCRIPTION OF THE DRAWINGS

The invention is explained in more detail below with the aid of two exemplary embodiments. In the associated drawings.

DETAILED DESCRIPTION OF THE DRAWINGS

Figure 1:
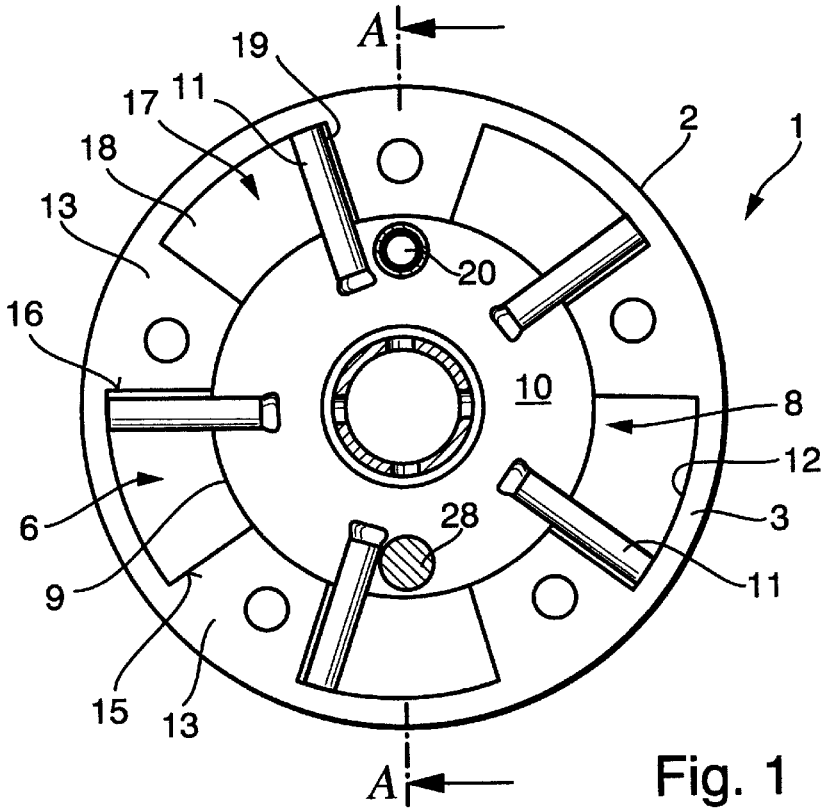
FIG. 1 shows a top view of a first embodiment of a device constructed according to the invention, with the side walls of the drive wheel removed.
Figure 2:
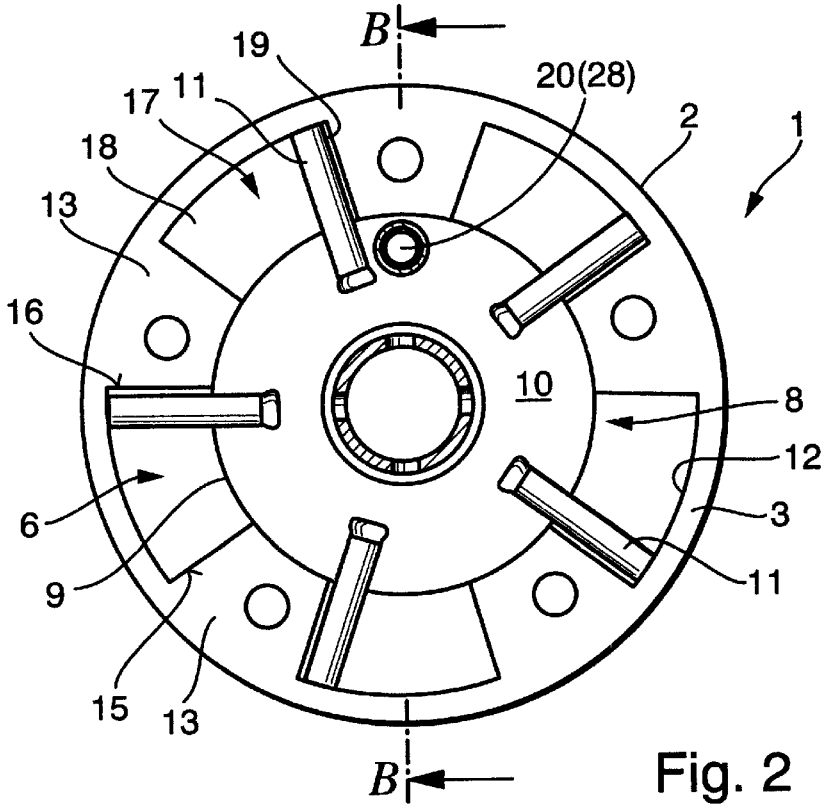
FIG. 2 shows a top view of a second embodiment of a device constructed according to the invention, with the side walls of the drive wheel removed.

FIGS. 1 and 2 respectively show a device 1 which is constructed as a camshaft adjusting device with an impeller, and by means of which the opening and closing times of gas-exchange valves of an internal combustion engine can be varied. This device 1 comprises a drive wheel 2, which is constructed as an outer rotor and is connected in driving terms to a crankshaft (not represented) of the internal combustion engine via a driving means. The drive wheel 2 in this case has a cavity 6 which is formed by a hollow cylindrical peripheral wall 3 and two side walls 4, 5 visible in FIGS. 3 and 4, the side wall 5 additionally having a tooth system 7 for the driving means, constructed as a drive chain in the particular case, of the device 1. Furthermore, the device 1 comprises an impeller 8 which is constructed as an inner rotor and connected in a rotationally fixed fashion to a camshaft (likewise not represented) of the internal combustion engine, and which is inserted into the cavity of the drive wheel 2 and has on the peripheral surface 9 of its wheel hub 10 five blades 11 arranged at uniform spacings.

Moreover, it may be gathered from FIGS. 1 and 2 that likewise extending from the inner lateral surface 12 of the peripheral wall 3 of the drive wheel 2 into the cavity 6 of the drive wheel 2 five radial bounding walls 13 directed toward the longitudinal center axis of the drive wheel 2 which are operationally connected to the wheel hub 10 of the impeller 8. Consequently, together with the peripheral surface 9 of the wheel hub 10 of the impeller 8, the lateral surfaces 15, 16 of these bounding walls 13 and the inner lateral surface 12 of the peripheral wall 3 form inside the device 1 five hydraulic operating chambers 17 which are respectively subdivided in turn into two hydraulic pressure chambers 18, 19 acting against one another by means of in each case a blade 11 of the impeller 8 extending into each operating chamber 17. Given an optional or simultaneous application of pressure by a hydraulic pressure fluid within a maximum pivoting angle, these pressure chambers 18, 19 effect a pivoting movement or fixing of the impeller 8 with respect to the drive wheel 2, and thus of the relative rotation or hydraulic clamping of the camshaft with respect to the crankshaft of the internal combustion engine.

Figure 3:
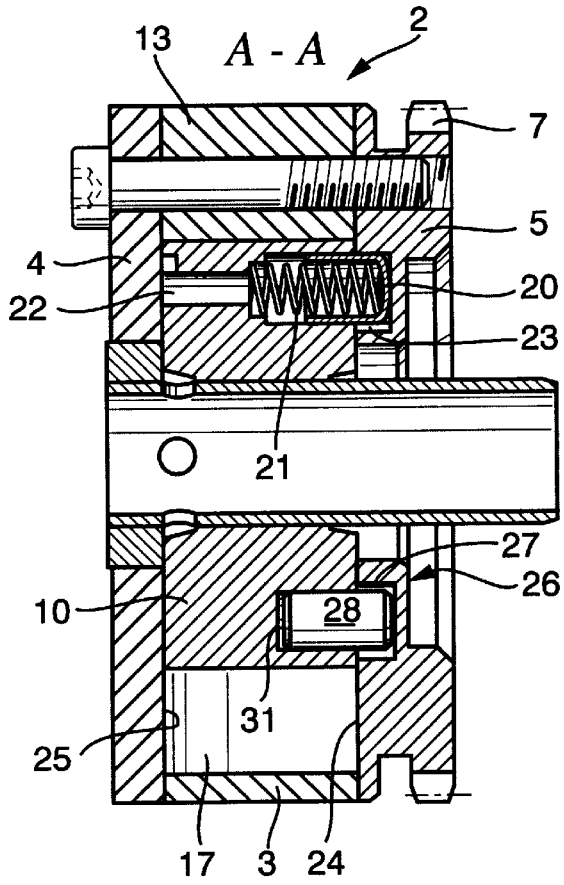
FIG. 3 shows a section A—A through the device constructed according to the invention according to FIG. 1, with mounted side walls of the drive wheel.

In the absence of the application of pressure by in each case one pressure chamber 18 or 19 of the device 1, such as, for example, when the internal combustion engine is at a standstill, the impeller 8 and the drive wheel 2 can additionally be intercoupled, for example in an early position, available for starting the internal combustion engine, of the camshaft with respect to the crankshaft, by a locking element 20 at least in one preferred mutual position. As represented in FIGS. 3 and 4, this locking element 20 is constructed as an axial pin which is arranged, together with a compression spring 21 in an axial bore 22 in the impeller 8 and can be displaced by the force of the compression spring 21 into a coupling position in a locking bore 23, visible in FIGS. 3*a* and 4*b*, in the opposite inner side 24 of a side wall 5 of the drive wheel. The locking bore 23 in this side wall 5 is connected in this case hydraulically with the pressure chamber 19 of the device in such a way that upon application of pressure by this pressure chamber 19, such as, for example, after starting the internal combustion engine, the axial pin can be moved again by the hydraulic pressure fluid into a decoupling position in the axial bore 22 in the impeller 8.

Moreover, it can clearly be seen from FIGS. 3 and 4 that the device 1 according to the invention has between the impeller 8 and the drive wheel 2 an additional angle-limiting device 26 with the aid of which it is possible to reduce the maximum pivoting angle of the impeller 8, which is limited by the lateral surfaces 15, 16 of the bounding walls 13 in the drive wheel 2, with respect to the drive wheel 2 to a smaller limiting angle, a virtually stepless reduction in the pivoting angle being rendered possible only by exchanging one component of the device 1 for another similar component of the device 1 which likewise reduces the pivoting angle. This angle-limiting device 26 comprises, on the one hand, an angle-limiting groove 27 which is in the shape of an annular segment and is recessed into the inner side 24 of the side wall 5 in the case of the first embodiment of the invention shown in FIGS. 1, 3 and 3*a*, and is recessed into the inner side 25 of the side wall 5 of the drive wheel 2 in the case of the second embodiment of the invention shown in FIGS. 2, 4, 4*a* and 4*b*, and whose radius origin is respectively arranged on the longitudinal center axis of the device 1. On the other hand, the angle-limiting device 26 comprises a stop bolt 28 which, depending on the embodiment of the invention, is arranged on the axial end of the impeller 8 opposite the side wall 4 or 5, and projects into the angle-limiting groove 27 in the side wall 4 or 5 of the drive wheel 2. The groove ends 29, 30, visible in FIGS. 3*a* and 4*a*, of the angle-limiting groove 27 are constructed in this case as angle-limiting stops against which the stop bolt 28 is arranged to bear in the maximum pivoting positions of the impeller (8) with respect to the drive wheel (2).

Figure 3A:
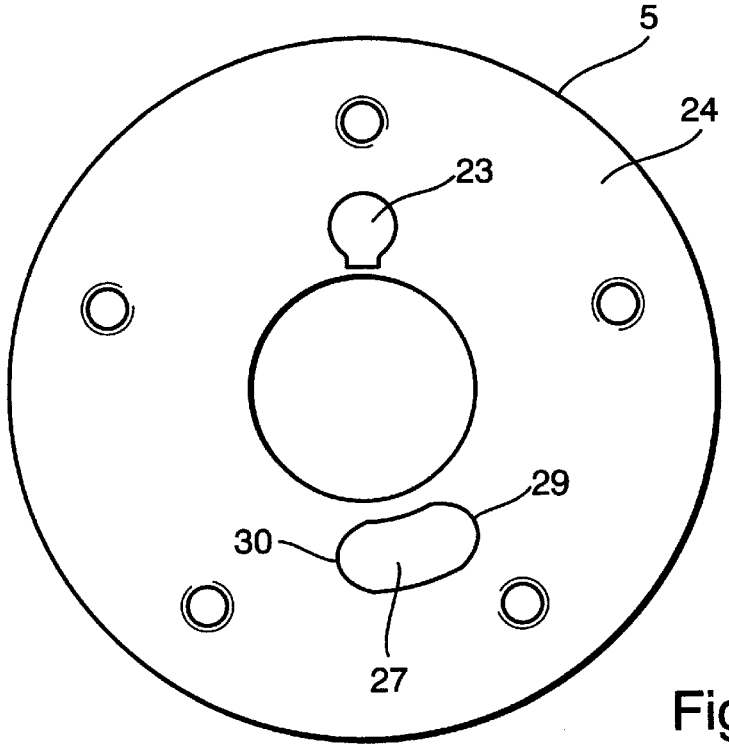
FIG. 3*a* shows a top view of the inner side of one side wall of the drive wheel of the device constructed according to the invention according to FIG. 3.
Figure 4B:
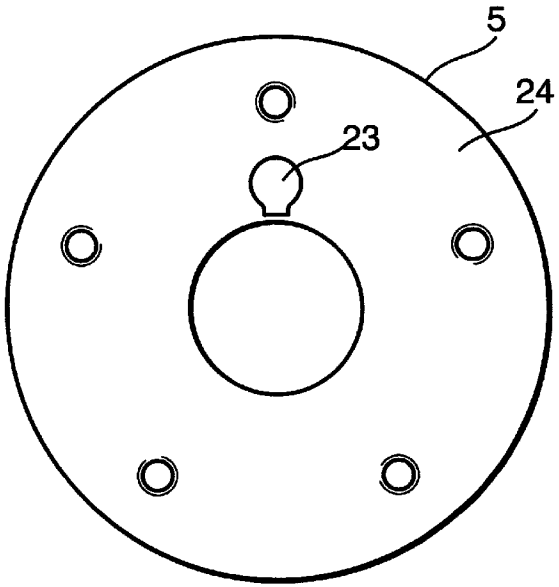
FIG. 4*b* shows a top view of the inner side of the other side wall of the drive wheel of the device constructed according to the invention according to FIG. 4.
Figure 4:
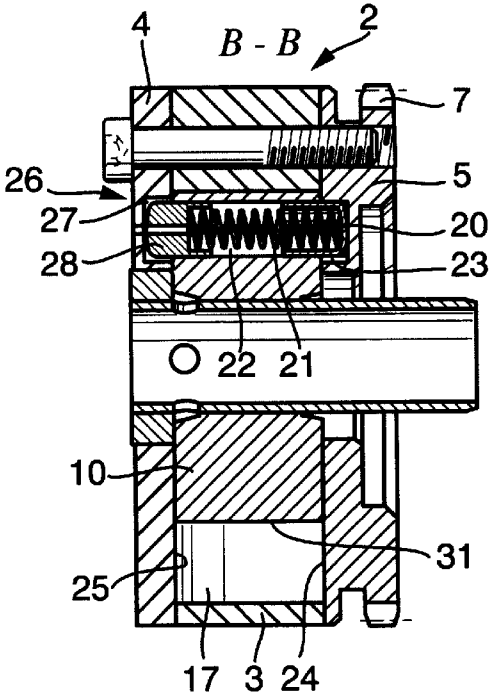
FIG. 4 shows the section B—B through the device constructed according to the invention according to FIG. 2, with mounted side walls of the drive wheel.
Figure 4A:
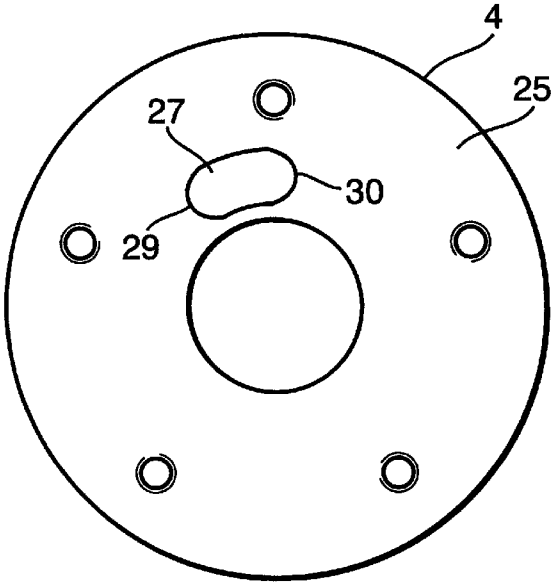
FIG. 4*a* shows a top view of the inner side of one side wall of the drive wheel of the device constructed according to the invention according to FIG. 4.

The first embodiment, represented in FIGS. 1, 3 and 3*a*, of the device 1 constructed according to the invention is also distinguished by the fact that the stop bolt 28 of the angle-limiting device 26 is fastened inside an axial blind bore 31 in the wheel hub 10 of the impeller 8, and is arranged with a part of its length projecting from this blind bore 31. In this case, the blind bore 31 is arranged radially with respect to the locking element 20, likewise arranged in the wheel hub 10 of the impeller 8, of the device 1 and is recessed into the same axial end of the wheel hub 10 on which the locking element 20 also acts. Consequently, as is to be seen clearly in FIG. 3*a*, the associated angle-limiting groove 27 of the angle-limiting device 26 is likewise arranged radially with respect to the locking element 20 in the same side wall 5 as the locking bore 23 thereof.

The second embodiment, represented in FIGS. 2, 4, 4*a* and 4*b*, of the device 1 constructed according to the invention differs from this in that the stop bolt 28 of the angle-limiting device 26 is fastened inside the axial bore 22, constructed as a through bore and arranged in the wheel hub 10 of the impeller 8, for the locking element 20 of the device 1, and is arranged likewise with a part of its length projecting from this axial bore 22. In this case, the stop bolt 28 is arranged on the axial end of the wheel hub 10 situated axially opposite the locking element 20 and, as indicated in FIG. 4, is simultaneously constructed at the rear as a support element for the compression spring 21 of the locking element 20. Moreover, FIGS. 4*a* and 4*b* clearly show that in this embodiment the associated angle-limiting groove 27 of the angle-limiting device 25 in which the side wall 5 of the drive wheel 2 situated axially opposite the side wall 4 with the locking bore 23 for the locking element 20 is arranged. Consequently, in this embodiment the side wall 4, constructed with the angle-limiting groove 27, of the drive wheel 2 forms the exchangeable component provided for the virtually stepless reduction in the pivoting angle between the impeller 8 and the drive wheel 2 of the device 1, while in the case of the first embodiment this is the side wall 5 of the drive wheel 2 which is constructed with the angle-limiting groove 27.

Finally, it is further indicated in FIGS. 3 and 3*a* as well as 4 and 4*a* that the width of the angle-limiting groove 27 and the doubled radius of its groove ends 29, 30 are constructed slightly greater than the diameter of the stop bolt 28, and at the same time the angle-limiting groove 27 is preferably constructed slightly deeper than the part of the stop bolt 28 projecting from the blind bore 31 or from the axial bore 22 in the wheel hub 10 of the impeller 8, with the result that the stop bolt 28 can move without making contact in the angle-limiting groove 27, and no frictional losses occur during the adjusting operation of the device 1 owing to the additional angle-limiting device 26.

What is claimed is:

1. Device for varying the control times of gas-exchange valves of an internal combustion engine, in particular a camshaft adjusting device with an impeller, having the following features:

the device (1) comprises a drive wheel (2) which is constructed as an outer rotor and is connected in driving terms to a crankshaft of the internal combustion engine via a driving means, the drive wheel (2) has a cavity (6) formed by a hollow cylindrical peripheral wall (3) and two side walls (4, 5), a tooth system (7) for the driving means being arranged on one of the side walls (4 or 5) or on the peripheral wall (3), the device (1) further comprises an impeller (8) which is constructed as an inner rotor, is connected in a rotationally fixed fashion to the camshaft of the internal combustion engine, is inserted into the cavity (6) of the drive wheel (2), and has at least one radially arranged blade (11) on the peripheral surface (9) of its wheel hub (10), extending from an inner lateral surface (12) of the peripheral wall (3) of the drive wheel (2) into the cavity (6) of the drive wheel (2) are at least two radial bounding walls (13) which are directed toward the longitudinal center axis of the drive wheel (2) and are operationally connected to the wheel hub (10) of the impeller (8), at least one hydraulic operating chamber (17) is formed inside the device (1) by lateral surfaces (15, 16) of the bounding walls (13) and by the inner lateral surface (12) of the peripheral wall (3) of the drive wheel (2) together with a peripheral surface (9) of the wheel hub (10) of the impeller (8), at least one operating chamber (17) of the device (1) is subdivided in turn into in each case two hydraulic pressure chambers (18, 19) acting against one another by in each case one blade (11) of the impeller (8) extending into this operating chamber (17), given an optional or simultaneous application of pressure by a hydraulic pressure fluid within a maximum pivoting angle, the pressure chambers (18, 19) effect a pivoting movement or fixing of the impeller (8) with respect to the drive wheel (2), and thus of the camshaft with respect to the crankshaft, characterized in that the device (1) has between the impeller (8) and the drive wheel (2) an additional angle-limiting device (26) with the aid of which the maximum pivoting angle of the impeller (8), which is limited per se by the lateral surfaces (15, 16) of the bounding walls (13) in the drive wheel (2), can be reduced with respect to the drive wheel (2) to a smaller pivoting angle, virtually stepless reduction in the pivoting angle being possible merely by exchanging a component of the device (1) or an element of this angle-limiting device (26) for another component, which likewise reduces the pivoting angle, of the device (1) or an element of the angle-limiting device (26), and the device (1) can be used while retaining all the remaining components on all internal combustion engines for which the possible relative angle of rotation between their camshaft and their crankshaft is smaller than or equal to the maximum pivoting angle, limited by the lateral surfaces (15, 16) of the bounding walls (13) in the drive wheel (2), of the impeller (8) with respect to the drive wheel (2).

2. Device according to claim 1, characterized in that the angle-limiting device (26)

on the one hand comprises an angle-limiting groove (27) in the shape of an annular segment recessed into an inner side (24 or 25) of one of said side walls (4 or 5) of the drive wheel (2) and whose radius origin is arranged on the longitudinal center axis of the device (1) and on the other hand comprises a stop bolt (28) which is arranged on the axial end of the impeller (8), which is situated opposite this side wall (4 or 5), and projects into the angle-limiting groove (27), the groove ends (29, 30) of the angle-limiting groove (27) being constructed as angle-limiting stops against which the stop bolt (28) is arranged to bear in the maximum pivoting positions of the impeller (8) with respect to the drive wheel (2).

3. The device as claimed in claim 2, in which in the absence of the application of pressure by in each case one pressure chamber (18 or 19) of the device (1), the impeller (8) and the drive wheel (2) can additionally be intercoupled by a locking element (20) in at least one preferred mutual position, the locking element (20) being constructed as an axial pin which is arranged, together with a compression spring (21) in an axial bore (22) in the impeller (8) and can be displaced by the spring force into a coupling position in a locking bore (23) in an opposing inner side (24 or 25) of one of said side walls (4 or 5) of the drive wheel (2), and the locking bore (23) in said one side wall (4 or 5) of the drive wheel (2) being connected hydraulically to at least one of said pressure chambers (18 or 19) of the device (1) in such a way that upon application of pressure by this pressure chamber (18 or 19) the axial pin can be moved again by the hydraulic pressure fluid into a decoupling position in the axial bore (22) in the impeller (8), characterized in that the stop bolt (28) of the angle-limiting device (26) is fastened inside an axial blind bore (31) in the wheel hub (10) of the impeller (8), and is arranged with a part of its length projecting from this blind bore (31), the blind bore (31) of the stop bolt (28) being recessed into one of the two axial ends of the wheel hub (10) and being arranged radially opposite the locking element (20), which is likewise arranged in the wheel hub (10) of the impeller (8), of the device (1), and the associated angle-limiting groove (27) of the angle-limiting device (26) likewise being arranged radially with respect to the locking element (20) in the respectively one or other side wall (4 or 5) of the drive wheel (2).

4. Device according to claim 2, in which in the absence of the application of pressure by in each case one pressure chamber (18 or 19) of the device (1), the impeller (8) and the drive wheel (2) can additionally be intercoupled by a locking element (20) in at least one preferred mutual position, the locking element (20) being constructed as an axial pin which is arranged, together with a compression spring (21) in an axial bore (22) in the impeller (8) and can be displaced by the spring force into a coupling position in a locking bore (23) in an opposing inner side (24 or 25) of one of said side walls (4 or 5) of the drive wheel (2), and the locking bore (23) in said one side wall (4 or 5) of the drive wheel (2) being connected hydraulically to at least one of said pressure chambers (18 or 19) of the device (1) in such a way that upon application of pressure by this pressure chamber (18 or 19) the axial pin can be moved again by the hydraulic pressure fluid into a decoupling position in the axial bore (22) in the impeller (8), characterized in that the stop bolt (28) of the angle-limiting device (26) is fastened inside the axial bore (22), constructed as a through bore and arranged in the wheel hub (10) of the impeller (8), for the locking element (20) of the device (1), and is arranged with a part of its length projecting from this axial bore (22), the stop bolt (28) being arranged on one of the two axial ends of the wheel hub (10), axially in each case with respect to the locking element (20), and simultaneously being constructed at the rear as a support element for the compression spring (21) thereof, and the associated angle-limiting groove (27) of the angle-limiting device (26) being arranged in the side wall (4 or 5) of the drive wheel (2) respectively situated axially opposite the side wall (4 or 5) with the locking bore (23) for the locking element (20).

5. Device according to claim 2, characterized in that the side wall (4 or 5), constructed with the angle-limiting groove (27), of the drive wheel (2) is constructed as the exchangeable component of the device (1) provided for the virtually stepless reduction of the pivoting angle between the impeller (8) and the drive wheel (2).

6. Device according to claim 3, characterized in that the width of the angle-limiting groove (27) in the shape of an annular segment and the doubled radius of its groove ends (29, 30) are constructed slightly greater than the diameter of the stop bolt (28), and the angle-limiting groove (27) is constructed slightly deeper than the part of the length of the stop bolt (28) projecting from the blind bore (31) in the wheel hub (10) of the impeller (8).

7. Device according to claim 4 characterized in that the width of the angle-limiting groove (27) in the shape of an annular segment and the doubled radius of its groove ends (29, 30) are constructed slightly greater than the diameter of the stop bolt (28), and the angle-limiting groove (27) is constructed slightly deeper than the part of the length of the stop bolt (28) projecting from the axial bore (22) in the wheel hub (10) of the impeller (8).

* * * * *